US009007410B2

(12) United States Patent
Taniguchi

(10) Patent No.: US 9,007,410 B2
(45) Date of Patent: Apr. 14, 2015

(54) HEATING HEAD UNIT AND HEATING HEAD

(71) Applicant: Hideo Taniguchi, Kyoto (JP)

(72) Inventor: Hideo Taniguchi, Kyoto (JP)

( * ) Notice: Subject to any disclaimer, the term of this patent is extended or adjusted under 35 U.S.C. 154(b) by 0 days.

(21) Appl. No.: 14/223,197

(22) Filed: Mar. 24, 2014

(65) Prior Publication Data

US 2014/0285607 A1 Sep. 25, 2014

(30) Foreign Application Priority Data

Mar. 25, 2013 (JP) ..... 2013-062727

(51) Int. Cl.
*B41J 2/335* (2006.01)

(52) U.S. Cl.
CPC ..... *B41J 2/3351* (2013.01); *B41J 2/3354* (2013.01); *B41J 2/33545* (2013.01); *B41J 2/3357* (2013.01)

(58) Field of Classification Search
USPC ..... 347/200, 201, 204–209, 58, 62
See application file for complete search history.

(56) References Cited

U.S. PATENT DOCUMENTS

| | | | | |
|---|---|---|---|---|
| 6,382,776 | B1 * | 5/2002 | Lee et al. | 347/62 |
| 7,019,765 | B2 * | 3/2006 | Fujiwara et al. | 347/173 |
| 7,206,009 | B2 * | 4/2007 | Taniguchi | 347/200 |
| 7,612,790 | B2 * | 11/2009 | Taniguchi | 347/200 |
| 2007/0176975 | A1 * | 8/2007 | Ueno | 347/58 |
| 2007/0188558 | A1 * | 8/2007 | Kuk et al. | 347/62 |

FOREIGN PATENT DOCUMENTS

| | | |
|---|---|---|
| EP | 1566275 | 8/2005 |
| JP | 2004268256 | 9/2004 |
| JP | 2008195046 | 8/2008 |

* cited by examiner

*Primary Examiner* — Kristal Feggins
(74) *Attorney, Agent, or Firm* — Perman & Green, LLP

(57) ABSTRACT

A heating head with not so long heating elements to be connected, being adaptable to long and two-dimensional media. On one surface of a rectangular head substrate having long and short sides, a strip-like heating element is provided continuously from end to end of the substrate along the long side thereof. A pair of electrode connecting portions including the same material as that of the heating element and extending along the short sides of the substrate is provided at both ends of the heating element. A pair of electrodes is formed on one surface of the substrate between the heating element and a side edge of the long side at the electrode connecting portion side, so as to be partially overlapping with the electrode connecting portions, respectively, thereby effecting electrical connection, and a substrate temperature control means is provided.

6 Claims, 10 Drawing Sheets

HEATING HEAD UNIT AND HEATING HEAD

CROSS-REFERENCE TO RELATED APPLICATIONS

This application claims priority to and the benefit of Japanese Patent Application No. 2013-062727 filed on 25 Mar. 2013, the disclosure of which is incorporated by reference herein in its entirety.

FIELD

The presently disclosed embodiment relates to a short heating head unit and a heating head for heating or two-dimensionally or three-dimensionally thermal processing of a medium having a wide width by arranging the heating head units one-dimensionally, two-dimensionally or three-dimensionally. The presently disclosed embodiment relates, in particular, to a heating head and a heating head unit having a strip-like heating element for heating a medium such as a heat-sensitive re-writable medium in order to carry out pre-treatment of a medium (purification, stabilization), main treatment of a medium (recording, transfer (re-transfer), erasing, or fixing (fixing of a toner), processing by post-treatment and heating (stabilization, or adhesion, fusion, or deformation by heating), over-coating, lamination of documents, adhesion of a sheet, sealing of a vinyl package, and imprinting (convexoconcave thermal processing of plastic and the like).

BACKGROUND

Recently information recording media (reversible or irreversible information recording media (re-writable card, re-writable sheet) provided with a recording portion comprising a reversible heat-sensitive recording layer) has been widely used, in which coloration, color change and erasing of color can be carried out reversibly or irreversibly repeatedly by heating on a base material in a shape of film, sheet or card made of a paper, non-woven fabric, woven fabric, synthetic resin such as vinyl chloride or polyethylene terephthalate, metal, glass, hard converted paper (paper for a card being harder than a cardboard and produced by curing a vegetable fiber or the like under pressure), or the like.

For example, a heating head having a structure as shown in FIG. 12 is known as a heating head for heating such a medium (for example, see JP 2004-268256 A). In FIG. 12, a heating head is configured such that a glass layer (glaze layer) not shown is provided on one surface of a head substrate 51 made of alumina or the like, a heating element 52 is provided thereon, and electrodes 53 are provided at both ends of the heating element. The electrodes 53 are designed such that wiring is led out from the head substrate 51 and is connected to a circuit board (not shown) located in the neighborhood of the head substrate 51 to enable a voltage to be applied to the heating element. As a result, a voltage is applied to the both ends of the heating element 52 through the pair of electrodes 53 and an electric current is flowed to generate heat on the heating element 52, thus enabling a temperature of the heating element 52 to be controlled by an amount of current. This head substrate 51 is held by adhering to a base 54 made of a metal plate or the like with an adhesive 55. In the example shown in FIG. 12, a concaved portion 56 is formed partly on the base 54 under the heating element 52, and a material having applicable heat conductivity different from that of the base is filled in the concaved portion 56 so as to inhibit escaping of heat from the head substrate 51 to the base 54.

SUMMARY

The above-mentioned heating head as shown in FIG. 12 is formed so as to have a length of, for example, about 20 to 300 mm. However, in the case of heating a medium having a width of, for example, 100 mm or more, a heating element also must be made to have a corresponding length. In the case of heating a wider medium, a heating element also must be made to have a longer length. Meanwhile, in the case of a heating element made generally by coating a heating element material and then carrying out sintering, there arises a problem that non-uniform resistance distribution occurs, thereby easily causing non-uniformity of temperature and making production steps difficult. Therefore, there is a problem that production steps are complicated. Further, even if the heating is carried out directly with the heating element 52, if media is fed continuously, since heating capacity of the heating element 52 is small, its temperature is decreased. In another aspect, if there is no feeding of media for a long period of time, the temperature of the heating element is easily elevated, and there is a problem that uniform heating is hardly carried out.

Further, while a protection layer made of glass is provided on a surface of a heating element for the purpose of preventing ablation and a short circuit due to adhesion of a foreign matter, as mentioned above, when records stored in a recording medium is erased by heating a heating element while flowing electricity thereto, passing the recording medium thereon and pressing the recording medium onto the heating element while pressing by a rubber roller, there arises a problem that the glass is easily broken, ablation of the glass is much and a resistance value of the heating element is likely to change since the glass is pressed directly on the heating element 52 with the rubber roller.

Furthermore, in order to heat a wide medium, if short heating heads are formed and are arranged to heat such a wide medium, there arises a problem that temperatures around electrode portions formed at both ends of the heating head become lower and a uniform temperature distribution cannot be obtained.

The presently disclosed embodiment has been made to solve the above-mentioned problems, and an aspect of the presently disclosed embodiment is to provide a heating head unit configured such that heating head units being as short as about 20 to 108 mm are connected without making a length of the heating element so long and that while measuring a temperature of each heating element, a voltage for heating is controlled, and another object of the presently disclosed embodiment is to provide a one-dimensional heating head for a long medium which can be applied to a wide medium by connecting the heating head units or a heating head being capable of two-dimensional or three-dimensional heating at once.

Another aspect of the presently disclosed embodiment is to provide a heating head unit and a heating head which are capable of heating at a stable temperature by adhering, to a surface of a heating element provided on one surface of a head substrate, a second substrate having a heat conductivity being different from that of the head substrate to improve heat conduction to the surface of the second substrate contacting the medium while protecting the heating element.

The heating head unit of the presently disclosed embodiment comprises a rectangular head substrate having long sides and short sides, a strip-like heating element provided continuously on one surface of the head substrate from one end to another end of the head substrate along its long side, a pair of electrode connecting portions formed from the same material as that of the heating element which are bent and extend along the short side of the head substrate at both ends of the heating element, a pair of electrodes formed on the one surface of the head substrate between the strip-like heating element and the side edge of the long side of the head substrate at the side where the electrode connecting portions are provided, wherein the electrodes are electrically connected with each other while being partially brought into contact with each of the pair of electrode connecting portions, and a substrate temperature control means for controlling the substrate temperature by measuring the temperatures of the head substrate and a temperature measurement element.

Herein, the medium means a material in a shape of film, sheet, card or plate made of paper (including a cardboard), non-woven fabric, woven fabric, synthetic resin such as vinyl chloride or polyethylene terephthalate, or the like. The medium includes reversible heat-sensitive recording media (re-writable card, re-writable sheet) comprising a base substrate made of the above-mentioned material and a recording portion provided on the base substrate and comprising a reversible heat-sensitive recording layer being capable of repeatedly conducting coloration and discoloration reversibly by heating; a recording paper used for transfer, re-transfer or toner fixing; a base film; the above-mentioned materials to be subjected to various processing such as adhesion, fusion, deformation, over-coating, under-coating, laminating or imprinting; and a gas such as air used for cultivating plants and adjusting a temperature of a vinyl house.

It is preferable, from the viewpoint of making the temperatures at both ends and at the center part of the heating element uniform, that at both ends of the heating element, an angle formed by the heating element and the electrode connecting portions is an acute angle by forming the heating element with a narrower width at the corner sections than a width at a middle portion, the angle being formed between the electrode connecting portion extending along the short side of the head substrate and the strip-like heating element extending along the long side of the head substrate.

The heating head of the presently disclosed embodiment is configured such that heating of a wide medium (in the case of being long in the direction of L in FIG. 1A) or heating of a medium two-dimensionally or three-dimensionally can be carried out by arranging two or more of the above-mentioned heating head units along the long side of the head substrate in a line and/or in a direction intersecting the long side of the head substrate and by disposing the heating element of one heating head unit adjacently to the heating element or the electrode connecting portion of another heating head unit.

In the heating head unit of the presently disclosed embodiment, the heating element is provided on one surface of the rectangular head substrate having long sides and short sides from one end to another end of the head substrate along the long side thereof, and is bent along the short side of the head substrate at both ends of the heating element to form the electrode connecting portions, and a pair of electrodes is formed so as to be partially brought into contact with each of the pair of electrode connecting portions. Thus, the heating element is formed from one end to another end of the head substrate. Therefore, by arranging two heating head units adjacently to each other, the length of the heating elements is the same as the length of the two heating head units. Further, it is possible to arrange three or more heating head units similarly in a line, and a heating head having a required width (length of the heating element) can be easily obtained according to a width of a medium to be processed. Also, since the electrode connecting portions are formed in a direction extending along the short side of the substrate at both ends thereof, there is no area where heating cannot be done in the direction of the long side even by the formation of the electrodes. On the contrary, while there is a tendency that there is an excessive temperature elevation of the electrode connecting portions at both ends, the temperature of the entire heating head can be made uniform by escaping heat to the electrodes and adjusting the width of the heating element.

Further, if the electrode connecting portion extending from the heating element along the short side is formed so as to extend up to the edge of the long side of the head substrate, or if the electrode connecting portion is formed so that at least a part thereof reaches the edge of the long side of the heating element, the electrode connecting portion or the heating element can be connected to the heating element of another heating head unit. Therefore, for example, a quadrangular two-dimensional heating head can be obtained. Even in this case of the two-dimensional heating head, each side of the quadrangular heating head can comprise a plurality of heating head units and a desired size of two-dimensional or three-dimensional heating head can be obtained. Also, by making the number of heating head units in a vertical direction different from that in a horizontal direction, a rectangular heating head can be formed. Further, in addition to a quadrangular shape, a two-dimensional heating head having three sides can be obtained, and by cutting the end of the head substrate diagonally, a triangular, Y-shaped or diagonal heating head but not one having a right angle such as a rectangle can be formed.

Furthermore, in the heating head unit of the presently disclosed embodiment, the length of the heating element (the length from one end to another end of the head substrate) can be about 20 to 108 mm, for example about 54 mm (a size to be used usually for printing and erasing of a card with a 2-inch head), and non-uniformity of electrical resistance of the heating element can be reduced as much as possible. In addition, the heating head can be easily handled and can be produced easily, and in the case of heating of a large medium having an A4 size, by arranging the required number of heating head units as mentioned above, a heating head large enough for a medium can be produced.

Further, in the heating head of the presently disclosed embodiment, the heating head is formed by arranging a plurality of heating head units providing a uniform temperature, non-uniformity of temperature of the respective heating head units can be adjusted with substrate temperature control means provided on the respective heating head units, and further, at the connection portion between the at least two heating head units, the heating element is provided up to the end of the head substrate, thereby causing no temperature decrease even at the jointed portions between the plurality of heating head units. Therefore, the temperature of the entire heating head is kept so uniform. Namely, in the heating head unit, an end-to-end substrate temperature is made uniform, and even if there arises non-uniformity of temperatures between the heating head units, since the substrate temperature control means are provided on the respective heating head units, the temperatures of the units can be made uniform by adjusting voltages to be applied to the heating elements, thereby making the temperature of the entire heating head uniform.

In the case where there is a heating head unit having a non-uniform temperature, it can be replaced with a heating head unit having a normal temperature distribution. Further, by designing the head substrate constituting the heating head unit so that the long side and the short side thereof form an acute angle (a smaller angle than a right angle) without intersecting at a right angle, a heating head having heating head units connected at an optional angle can be obtained, and a heating head having a rhombic shape, Y-shape or the like shape can also be obtained. In addition, by using such a connection structure, heating head units can be inserted crosswise on diagonal lines of a quadrangle formed from other heating head units, and, for example, a three dimensional heating head can be formed and a three dimensional vinyl bag can be easily produced. Furthermore, since temperature control means are provided on the respective heating head units, even if temperature changes due to environmental variation, each heating head unit can follow such a change. Therefore, it is possible to carry out temperature control in a vinyl house and temperature control around vegetables depending on kinds thereof.

DETAILED DESCRIPTION

Figure 1A:
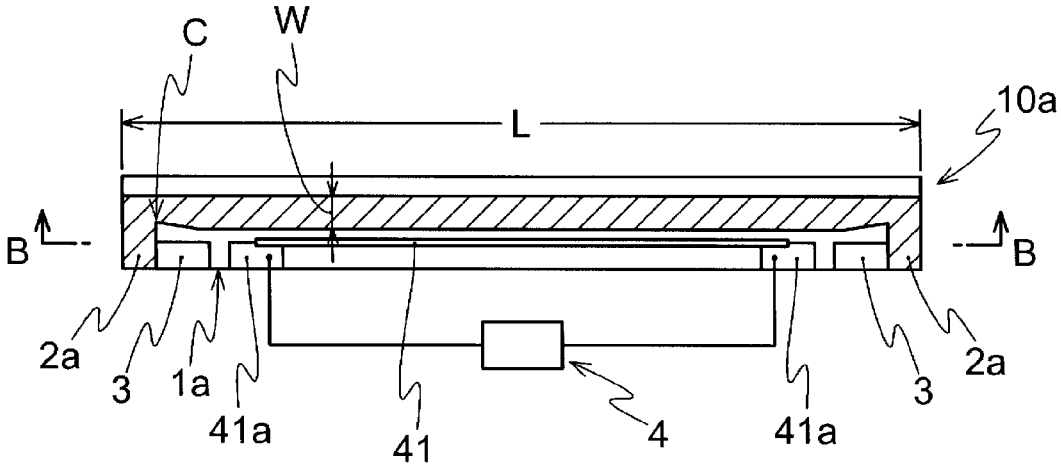
FIG. 1A is a plan view of one embodiment of the heating head unit of the presently disclosed embodiment, wherein a heating element, a temperature measurement element and electrodes are formed on a head substrate.

Next, the heating head unit of the presently disclosed embodiment and the heating head using the unit are explained below referring to the drawings.

Figure 1B:
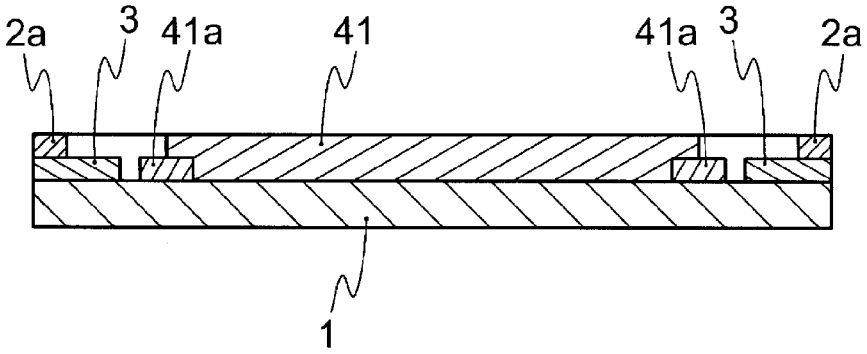
FIG. 1B is a sectional view of B-B line of FIG. 1A.

In the heating head unit of the presently disclosed embodiment, as shown in FIG. 1A, the plan view of one embodiment thereof, wherein a heating element (a register generating heat by current), a temperature measurement element (a register for measuring a temperature of the head substrate) and electrodes are formed on a head substrate and in FIG. 1B, the sectional view of B-B line thereof, there is provided a strip-like heating element 2 on one surface of a rectangular head substrate 1 having long sides and short sides, continuously from one end to another end of the head substrate along its long side. At both ends of the heating element 2, a pair of electrode connecting portions 2*a* is formed using the same material as that of the heating element 2, and is bent and extends along the short side of the head substrate 1 at both ends of the heating element 2. Further, a pair of electrodes 3 is formed on the one surface of the head substrate 1 between the strip-like heating element 2 and the side edge of the long side of the head substrate 1 at the side where the electrode connecting portions 2*a* are provided, wherein the electrodes 3 are electrically connected with each other while being partially brought into contact (overlapped) with each of the pair of electrode connecting portions 2*a*. Further, a substrate temperature control means 4 for controlling the substrate temperature by measuring the temperatures of the head substrate 1 and a temperature measurement element 41 is provided. In addition, it is not necessary to provide the temperature measurement element 41 for such an exclusive use as shown in FIGS. 1A and 1B, and a configuration for the temperature measurement using the heating element 2 may be used.

The head substrate 1 has a substantially rectangular shape of about 20 to 108 mm length, about 5 to 25 mm width and about 0.6 to 1.0 mm thickness. Its material is one having as excellent a heat conductivity as possible, namely one having about 1 (e.g. soda glass) to 200 W/(m·k) of heat conductivity, and having heat resistance under heat generation temperature condition at the time of use and insulating properties on its surface where the heating element 2 is provided. For example, ceramics such as alumina (Vickers' hardness Hv: about 20) and aluminum nitride can be used. The head substrate 1 may be one produced by printing and baking a thick film paste for insulation on a surface of a metal plate such as stainless steel to form an insulating film in a thickness of about 5 to 20 μm.

Figure 8:
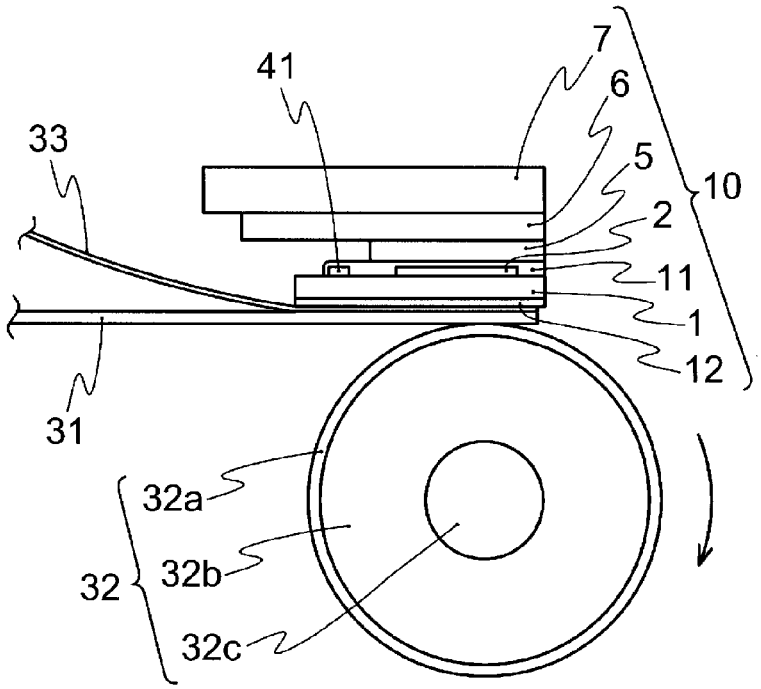
FIG. 8 is a schematic view of a device for heating a medium using the heating head of the presently disclosed embodiment.

In the example shown in FIG. 1A, the heating element 2, etc. to be explained infra are formed on one surface of the head substrate 1, and since another surface (back surface) and side surfaces of the head substrate 1 are surfaces which contact with the medium by pressing, it is preferable that the another surface and side surfaces are formed to be as smooth as possible by polishing or by adhering a silicone sheet 12 or the like with an adhesive for silicone, in which a polytetrafluoroethylene film is coated thin on one surface and an another surface of the silicone sheet 12 is adhered (See FIG. 8). The reason for such a structure is as follows. Generally PET (polyethylene terephthalate), or paper coated with wax is used in many cases as a medium. When being transferred while being press-contacted with a heating head 1 having coarse alumina, the surface of the medium contacting with the heating head 1 is scratched, and also when there is unevenness on the surface of the medium due to embedding of IC or the like, the medium is not transferred smoothly.

The heating element 2 is formed in a strip-like shape extending from one end to another end of the head substrate 1 along the long side of the head substrate 1. The pair of electrode connecting portions 2*a* is formed from the same material as that of the heating element 2, and is bent and extends along the short side of the head substrate 1 at both ends of the heating element 2. The electrode connecting portions 2*a* are caught on a part of a pair of previously formed electrodes 3 to be explained infra. Therefore, the heating element 2 and the pair of electrode connecting portions 2*a* are formed integrally in one unit, and are configured such that the electrodes 3 are connected to both ends of the heating element 2 via the electrode connecting portions 2*a*. The width w of this heating element 2 can be determined depending on the purpose of heating a medium, and for the purpose of heating a usual card, the width is from about 2 to 10 mm. The length L of the heating element 2 is determined to an end-to-end size of the above-mentioned head substrate 1 and is, for example, from about 20 to 108 mm. The number of the heating elements 2 may be two or more instead of one heating element 2 as shown in FIG. 1A.

In the example shown in FIG. 1A, the electrode connecting portion 2*a* extending along the short side is formed so as to extend up to the end in the widthwise direction of the head substrate 1, namely up to the side edge 1*a*. For example, in the case of using one heating head unit 10, or arranging heating head units one-dimensionally only in the lengthwise direction to use as a heating head, there may be a space between the end of the electrode connecting portion 2*a* and the side edge 1*a* without extending the electrode connecting portion 2*a* up to the side edge 1*a*. However, as shown in FIG. 1A, if the end of the electrode connecting portion 2*a* is configured so as to reach the side edge 1*a* of the head substrate 1, it is preferable because there causes no discontinuity of temperature distribution in the case of forming a two-dimensional heating head to be explained infra.

Figure 1C:
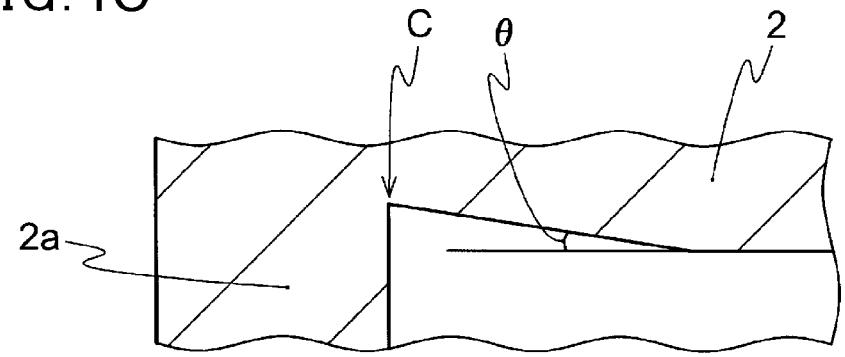
FIG. 1C is an enlarged view of a corner portion C.

Further, in the example shown in FIG. 1A, there are formed the electrode connecting portions 2*a* in the form bent at the both ends of the heating element 2, and at the corner portion thereof, the width of the heating element 2 is formed narrower than that of the center portion. Namely, at the both ends of the head substrate 1, the electrode connecting portions 2*a* are formed, and since they are formed at the ends, the temperature thereof is likely to decrease, and therefore, for the purpose of achieving uniformity of temperature between the ends and the center side of the heating element 2, the width of the heating element 2 is made narrow to easily keep the temperature high. It is preferable to make the width of the heating element 2 narrow continuously as compared with narrowing discontinuously. Therefore, for that purpose, as the corner portion is shown in an enlarged view of FIG. 1C, one side of the heating element 2 is tapered. As a result of various studies using a heating head unit having a length L of 54 mm and a width w of 3.5 mm, it is preferable that an angle θ in a lengthwise direction of the tapered portion is an acute angle of from 5 to 25 degrees since a temperature difference between the end side and the center side can be almost eliminated.

In the example shown in FIG. 1A, the angle formed by the tapered portion and the edge portion of the electrode connecting portion 2*a* is also an acute angle, and this corner portion may be formed into an arc. Namely, by making the width of the heating element 2 narrow, a resistance at the width of the corner portion of the heating element 2 becomes large though the resistance is not restricted by the shape of the corner portion, thereby contributing to the temperature rise at this narrowed portion. Even in the case of the corner portion being an arc, the above-mentioned angle θ is the same.

In short, the presently disclosed embodiment is characterized in that the heating element 2 is formed from one end to another end of the head substrate 1 in the direction of its long side (lengthwise direction) and the electrodes 3 are formed on the same surface of the head substrate 1. Namely, in usual heating heads, a pair of electrodes is formed at both ends in the direction of a head substrate 1 or on a back surface of a head substrate by leading a wire up to the back surface of the head substrate. However, the heating head unit of the presently disclosed embodiment is characterized in that a plurality of heating head units can be connected while avoiding a configuration of directly pressing a medium via a protection film formed on the surface of the heating element 2. As a result, the temperature can be raised uniformly up to the end of the head substrate 1 and a long heating head or a two-dimensional heating head can be formed. Since the electrodes for flowing electric current through the heating element 2 are formed at the positions apart from each other in the widthwise direction of the heating element 2, the temperature characteristics of heating element 2 are not affected at all by the electrodes, and also, even if unevenness of the heating head arises due to formation of the electrode, it does not have an effect at all on the pressing of a medium. As a result, by arranging the heating head units 10 (See FIG. 2D) in a crosswise and/or lengthwise direction in this drawing, the heating elements 2 can be arranged continuously without a space between them. Further, by forming the long side and the short side in an oblique form at the end of the head substrate, the heating head units can be arranged not only in a crosswise and/or lengthwise direction but also in an oblique direction without causing discontinuity of the temperature. Namely, heating heads having, in a planar shape thereof, various shapes such as L shape, X shape, Y shape and Z shape can be formed. Further, heating heads can be arranged not only on the same plane but also in three dimensions.

The heating element 2 and the electrode connecting portions 2*a* are formed by coating with a paste comprising Ag, Pd and glass or Ag and glass and then baking. A paste further comprising RuO2 can also be used. In the case of an Ag—Pd alloy formed by baking, a sheet resistance per unit area of 100 mΩ/Sq to 500 mΩ/Sq can be obtained (the sheet resistance varies with a mixing ratio, an amount of a solid insulating powder, a printing thickness, baking conditions or the like), and a resistance value and a temperature coefficient can be changed by a mixing ratio of the both. For example, the heating element 2 and the electrode connecting portions 2*a* are formed with settings such as a sheet resistance value of about 200 mΩ/Sq, a width of 5 mm, a length of 100 mm, a thickness of about 10 μm, (total resistance of about 3.6Ω) and a temperature coefficient of the resistance of about 1500 ppm/° C. (a resistance value changes by 15% when a temperature changes by 100° C.). This heating element 2 is formed by printing so as to overlap with a pair of electrodes provided at the both end sides in the lengthwise direction of the head substrate 1 via the electrode connecting portions 2*a*.

The sheet resistance and the like of the heating element 2 is set depending on a size of a medium to be heated, a processing speed of a medium (a record erasing speed, namely, a speed at which a medium passes over the heating head) and the like. For example, in the case of a head substrate 1 made of alumina and having a size of a width, a length and a thickness of 7 mm, 104 mm and 0.8 mm, respectively, an amount of heat necessary for elevating a temperature of the head substrate 1 by 1° C. is 1.76 J, and in order to elevating it to 150° C., 150×1.76=264 J is required. For example, when the resistance between the both ends of the heating element 2 is designed to be 3.6Ω, by application of a voltage of 24 V, an amount of heat of 160 W is generated, and so, a required amount of heat can be supplied in 264 J/160 W=1.65 seconds. Namely, when starting the heating head, it is necessary to wait for about 1.65 seconds until the substrate temperature reaches a predetermined temperature of about 170° C., and thereafter, since a heating capacity of the head substrate 1 is extraordinarily large unlike only conventional thin heating element 2, a medium can be continuously heated almost without non-uniformity of temperature even if the medium is passed at high speed.

Figure 6:
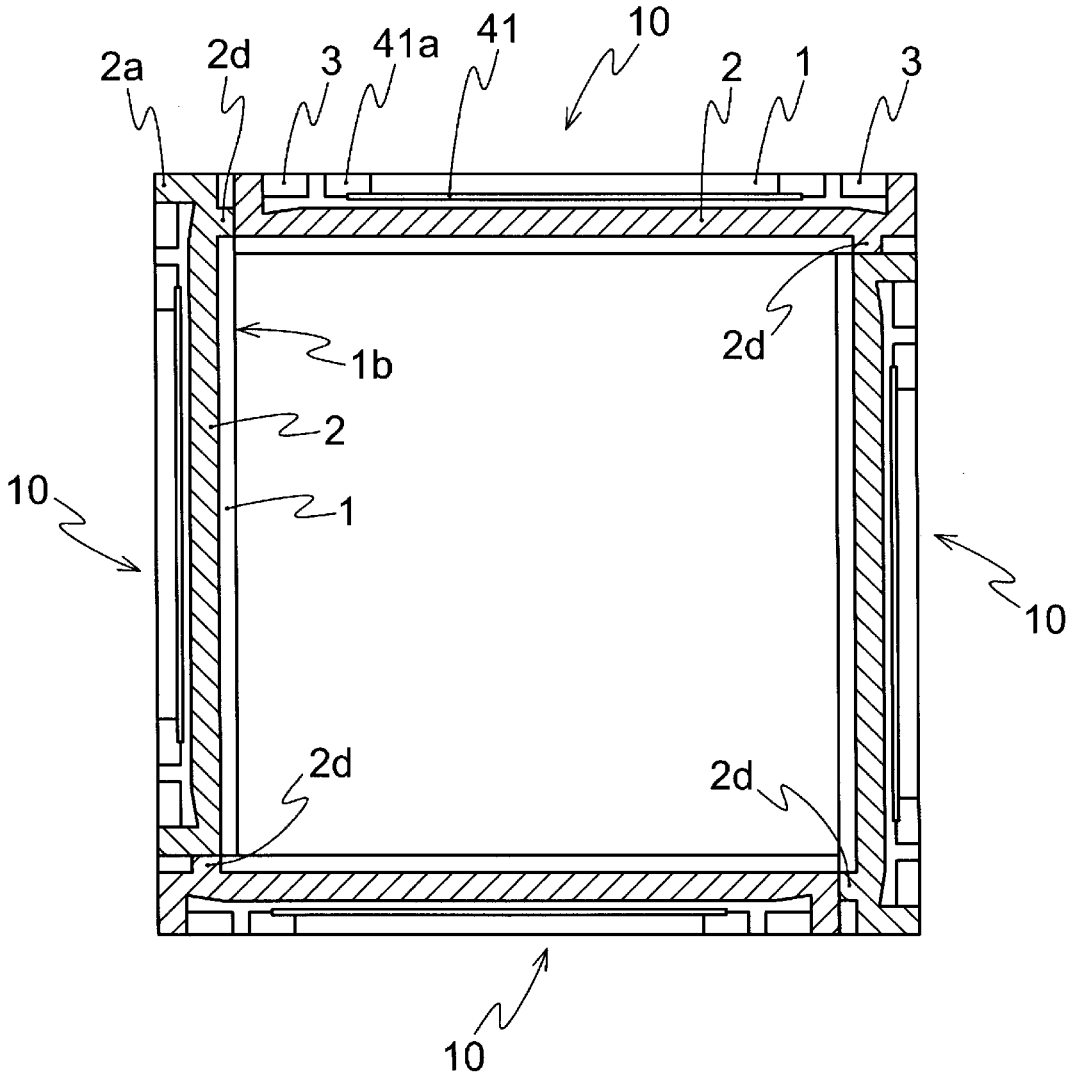
FIG. 6 is a plan view of other example of a two-dimensional structure of the heating head of the presently disclosed embodiment.

On nearly the entire surface of the head substrate 1 except a width of about 2 mm from the edge at the sides where the electrode connecting portions 2*a* are formed, one or a plurality of heating elements 2 is arranged in parallel. As shown in FIG. 1A, a space may be provided between the heating element 2 and the side edge 1*b* (See FIG. 6) opposite to the side where the electrode connecting portions 2*a* are provided or the heating element 2 may be configured so as to be formed up to the side edge 1*b*. Either configuration may be adopted. In the case of forming a plurality (set) of heating elements at once on a wide large head substrate and thereafter, cutting the head substrate and separating each of the heating head units, it is preferable to provide a space without forming the heating element 2 up to the side edge 1*b*, because the separation is easy. Meanwhile, when the heating element 2 is formed without forming a space up to another side edge 1*b*, the heating element 2 of the other heating head unit 10 can be connected thereto, as shown in FIG. 6, and it is easy to form a two-dimensional heating head. In this case, as shown in FIG. 6 explained infra, the heating element 2 can be formed so that its portion contacting the other heating head unit 10 reaches the side edge 1*b*. This will be explained infra.

As mentioned above, the number of heating elements to be formed can be one or plural, and a plurality of electrode connecting portions can be formed into one (by connecting the ends of the plural portions).

Heat generating characteristics of the heating element 2 can be designed freely, and for a temperature measurement element or a heating element 2 for temperature measurement explained infra, it is preferable to use a resistive material having a larger temperature coefficient at zeroth order of the resistance, in particular, a material having a temperature coefficient of the resistance of from 1000 to 3500 ppm/° C., in order to detect and control a temperature of the heating element 2 or the temperature measurement element and to prevent overheating due to thermal runaway. A material having a large temperature coefficient makes it easy to accurately measure the temperature of the head substrate 1 and carry out temperature control.

The pair of electrodes 3 is formed so as to partially overlap the electrode connecting portions 2*a* provided at both ends opposite to each other in the lengthwise direction of the head substrate 1 and is made, for example, by printing and sintering in the same manner as in the heating element 2 using a silver-palladium alloy or silver-platinum alloy having good conductivity and a smaller palladium ratio than that of the material of the heating element 2. The pair of electrodes 3 may be formed before forming the heating element 2 and the electrode connecting portions 2*a* or may be formed after forming the heating element 2 and the electrode connecting portions 2*a* so as to be placed on the electrode connecting portions 2*a*. In the presently disclosed embodiment, the surface of the heating element 2 is not pressed directly onto a medium, and since the medium is pressed onto the other surface or side surface of the head substrate 1 or onto the second substrate formed on the surface of the heating element 2 and explained infra, the pair of electrodes 3 can be easily connected to power source by connecting a lead not shown in the drawing directly to the pair of electrodes 3 by welding or soldering using a high temperature solder. As a result, for example, even in the case of connecting a plurality of heating head units, heating can be carried out easily by connecting and earthing two electrodes at the joint portion of the heating head units using a lead and connecting a plus (or minus) side of separate power sources to the respective other side electrodes.

The temperature measurement element 41 is not intended to be used for heating, and therefore, is formed as a thin resistance film changing its resistance value to a large extent depending on the temperature. While the temperature measurement element can be formed from the same material as that for the heating element 2, in the case of forming a temperature measurement element 41, it is preferable to form it using a material changing its resistance value to a large extent depending on a temperature change. In the example shown in FIG. 1A, on the surface of the head substrate 1, the temperature measurement element 41 and a pair of temperature measuring electrodes 41*a* are formed between the heating element 2 and the edge 1*a* formed at the side where the electrode connecting portions 2*a* are formed and moreover in a space between the pair of electrodes 3, so that the both ends of the temperature measurement element 41 are connected to the temperature measuring electrodes 41*a*. The temperature measurement element 41 is connected to a DC power source 42 and a reference resistance 43 as shown in FIG. 11 explained infra, and is designed so as to be able to measure the temperature of the head substrate 1, adjust a power source 9 to be applied to the heating element 2 and maintain the temperature of the head substrate 1 at a specific temperature.

Figure 11:
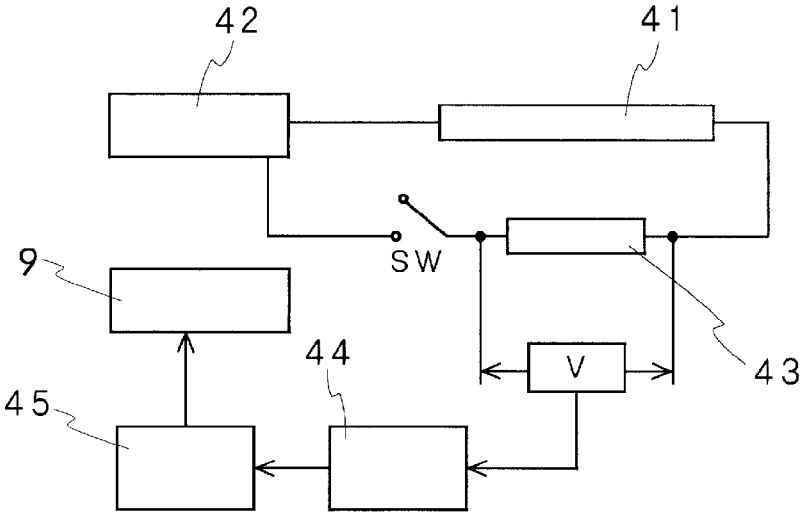
FIG. 11 is a circuit diagram showing an example of a substrate temperature control means for measuring a substrate temperature of the heating head unit of the presently disclosed embodiment and controlling the temperature.
Figure 12A:
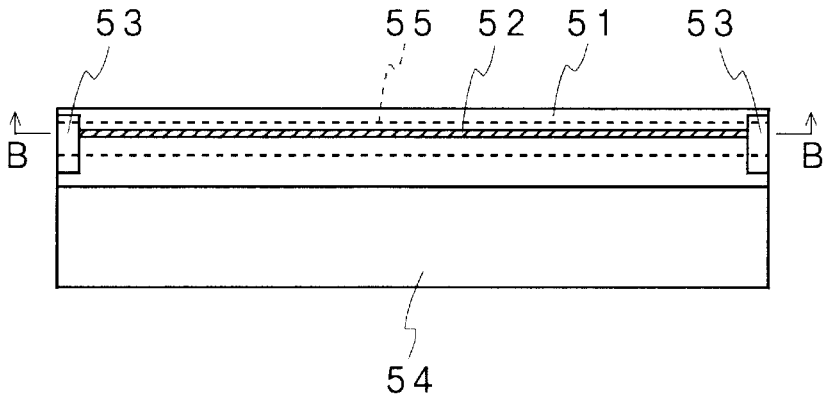
FIGS. 12A and 12B are views of an example showing a configuration of a conventional heating head.
Figure 12B:
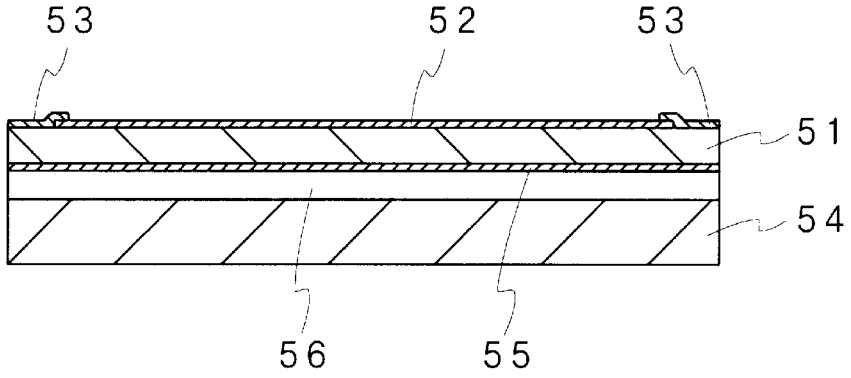

Namely, for example, as shown in FIG. 11, by connecting the temperature measurement element 41 and a reference resistance 43 in series at both ends of the DC power source 42 and measuring voltages V at both ends of the reference resistance 43 with a temperature detecting means 44, the temperature of the heating element 2 can be obtained from a change of the voltage and the temperature coefficient of the temperature measurement element 41 (varies with the material) known in advance. The temperature of the head substrate 1 can be controlled to a given temperature by controlling the power source 9 to be applied to the both ends of the heating element 2 with a control means 45. In the examples shown in FIGS. 1 to 7, the temperature measurement element 41 is provided separately from the heating element 2. However, as mentioned above, the temperature of the head substrate 1 can be controlled by measuring its temperature using the heating element 2.

In this temperature control of the heating element 2 with the control means 45, an AC voltage or a DC voltage can be applied to the heating element 2 and thus, an applied voltage can be changed, and also, the temperature of the heating element 2 can be adjusted by carrying out duty drive and changing a duty cycle. It is desirable that the reference resistance 43 is one having a small temperature coefficient. It is preferable that the temperature measurement element 41 is one having a width of about 0.3 to 0.5 mm and is mounted on a suitable position of the head substrate 1. The applied voltage is preferably as low as about 5 V so that heat is not generated on the temperature measurement element 41. Thereby, the temperature at the portion of the head substrate 1 to be pressed onto the medium can be presumed.

Figure 2A:
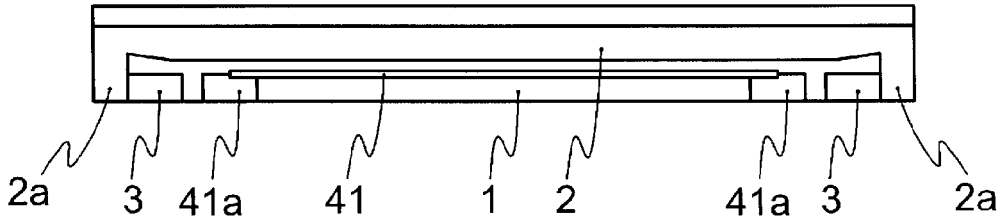
FIGS. 2A, 2B and 2C are side views showing a process until a second substrate is adhered to a surface of the head substrate shown in FIG. 1A.
Figure 2B:
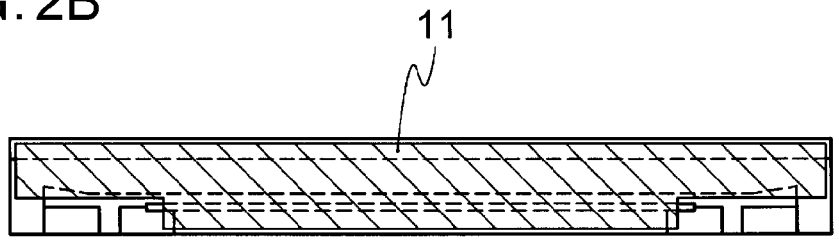
Figure 2C:
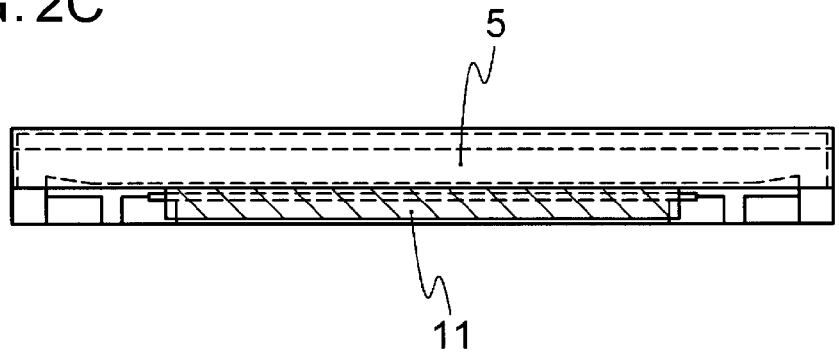

The plan views of FIGS. 2A to 2C show an intermediate heating head unit 10*a*, wherein the heating element 2, the pair of electrodes 3, the temperature measurement element 41 and the pair of electrodes 41*a* at both ends thereof are formed on the head substrate 1. As shown in FIG. 2B, on the surface of the intermediate heating head unit 10*a*, a glass paste is coated by screen printing and dried so as to cover surfaces of the heating element 2 and the temperature measurement element 41. As shown in FIG. 2C, the second substrate 5 is laid on the surface of the heating head unit by coating and drying a glass paste in the same manner as above to an extent to cover the heating element 2 but not the temperature measurement element 41 and then melting the paste by heating at about 510° C., thereby adhering the second substrate 5 to a glass film 11 and the like. This second substrate 5 can be a substrate having about the same thickness of from 0.6 to 1 mm as that of the head substrate 1, and the glass film is formed in a thickness of about 20 to 40 μm. Since it is better to expose the pair of electrodes 3 for the connection to the power source 9, the second substrate 5 is formed at the side of the surface of the heating element 2. However, when a lead portion for connecting to the electrodes 3 with a wire is formed, the whole unit can be covered with the second substrate 5.

As mentioned above, in the case of using the other surface or the side surface of the head substrate 1 as a pressing surface with the medium, it is preferable that the second substrate is made of a material having the same thermal expansion coefficient as that of the head substrate 1 and a heat conductivity smaller than that of the head substrate 1. However, from the viewpoint of a thermal expansion coefficient being near to each other, a material such as alumina or the like which is the same as the head substrate 1 can be used as the second substrate. This is because while the heating element 2 is provided directly on the head substrate 1, the second substrate 5 is provided through the glass film 11 and the temperature of the head substrate 1 is easily raised compared with the second substrate 5. The reason why the second substrate 5 preferably has the thermal expansion coefficient which is the same as or near to that of the head substrate 1 is that it is necessary that the second substrate 5 should not be separated in the heat cycle of elevation and lowering of the temperature of the head substrate 1. However, the surface of the second substrate 5 can be a surface for pressing onto the medium. In that case, it is preferable to select a material of the second substrate 5 having larger heat conductivity than the head substrate 1. Even in such a case, the same material as that of the head substrate 1 can be used for the second substrate 5.

Figure 2D:
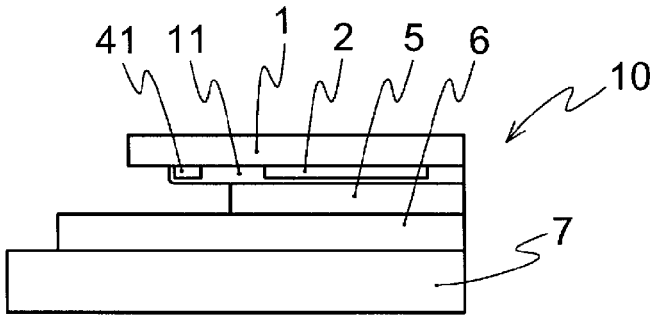
FIG. 2D is a side view showing a state of the second substrate being adhered to a base via a circuit board.

As shown in FIG. 2D, a base 7 is fixed on the surface of the second substrate 5 via a circuit board 6. The fixing can be carried out using a heat resistant adhesive (silicone resin, epoxy resin or the like) or using a screw. A printed circuit board can be used as the circuit board 6, and also used as an electrical circuit substrate for the use as a relay with each of the electrodes 3 and 41*a*.

As mentioned above, the circuit board 6 can be used for connection of each of the electrodes 3 and 41*a* with the power source and is provided with parts for detecting the temperature of the head substrate 1, and therefore, is formed, for example, from a printed circuit board, but can also be formed from a flexible film. This circuit board 6 can be connected with a connector, a wire, a screw terminal, or the like by providing a high-current terminal, a temperature measuring terminal or the like on the circuit board. In addition, by providing a thermal fuse on the circuit board, it is possible to shut off voltage application to the electrodes 3 in the case where the temperature of the head substrate 1 is elevated excessively.

A metal plate such as an aluminum plate (heat conductivity: 221 W/(m·K)) and an iron plate (heat conductivity: 83 W/(m·K)), ceramics such as aluminum nitride and aluminum oxide, and the like can be used as the base 7, and is used for holding the head substrate 1. This base 7 is formed into a size corresponding to the head substrate 1, and the thickness thereof is, for example, about 7 mm. The heating head unit is so formed as mentioned above.

Figure 3:
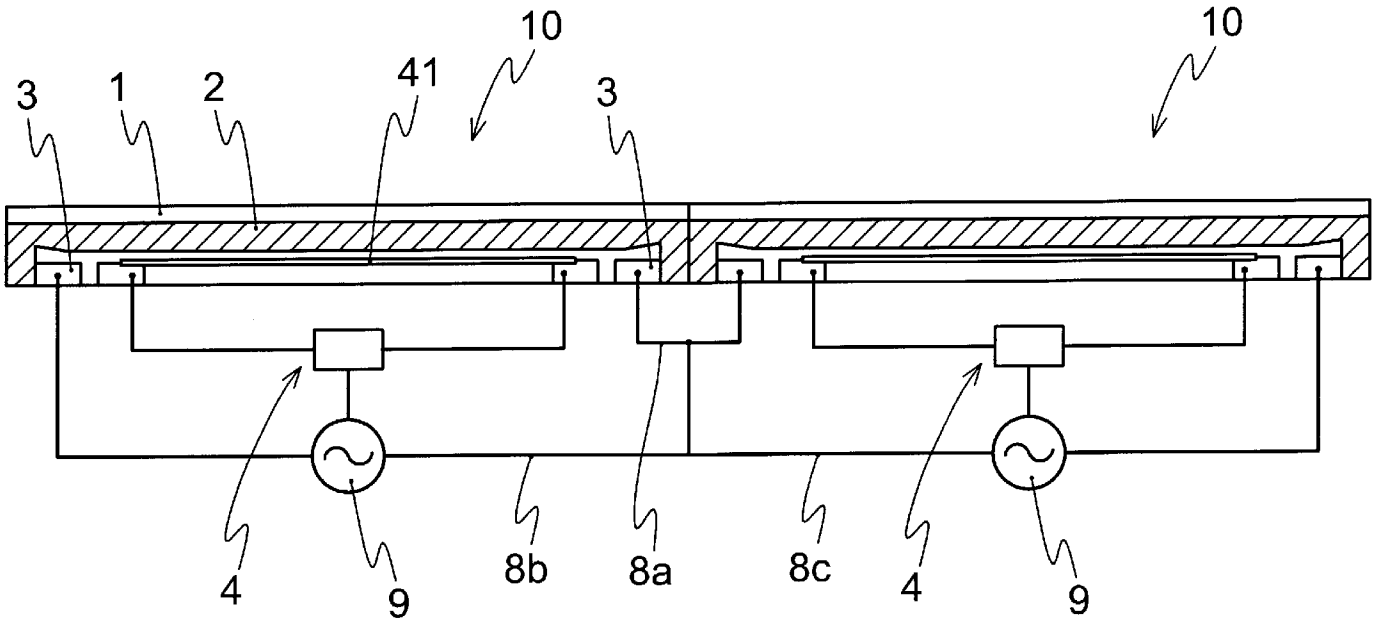
FIG. 3 is a plan view of one embodiment of the heating head of the presently disclosed embodiment, wherein two of the heating head units shown in FIG. 1A are in a state of being arranged in a row.

FIG. 3 is a view like a circuit diagram, wherein in the plan view similar to FIG. 1A where two heating head units 10 shown in FIGS. 1 and 2 are arranged so that two heating elements 2 are arranged continuously, thereby forming the heating head, a substrate temperature control means 4 and a power source for the heating element 2 are connected to the pair of electrodes. As shown in FIG. 3, the heating head units 10 are arranged so that the heating elements are continuously connected to each other in the lengthwise direction, and therefore, the heating elements 2 of the neighboring heating head units 10 are brought into contact with to each other and the electrode connecting portions 2*a* at the ends of the respective heating elements are in a state of being in contact with each other. These two heating head units 10 are fixed onto a substrate not shown in the drawing. The pair of electrodes 3 of one of the two neighboring heating head units 10 is connected to each other with a lead 8*a*, and the lead 8*a* is connected to the other electrodes 3 of the respective heating head units 10 with leads 8*b* and 8*c* via the power sources 9. These power sources may be either a DC power source or an AC power source. In the case of a AC power source, commercial power source can be used and the heating head can be operated at low cost. In this case, the power sources are designed so as to be able to be stepped down if necessary depending on a series resistance value of the heating elements 2. In that case, in the AC power sources 9, there are a grounding terminal and other power source terminal. When the grounding terminal is connected to the lead 8*a* connecting the electrodes 3 of the two neighboring heating head units 10 and the other power source terminal is connected to the other electrodes 3, there arises no problem with a phase difference or the like.

As explained above with respect to FIG. 11, the power source 9 and the substrate temperature control means 4 of each unit 10 are connected to each other, and therefore, in the case where there is a difference in temperature between the two heating head units 10, it is possible to make the both temperatures uniform by controlling the power source 9 of the heating head unit 10 having a temperature different from the predetermined temperature. Therefore, a heating head having a double length, for example, 108 mm length can be obtained. The number of heating head units 10 to be connected is not limited to two, and any number of heating head units can be connected. Thus, a heating head capable of heating a desired wide medium can be obtained.

Figure 4:
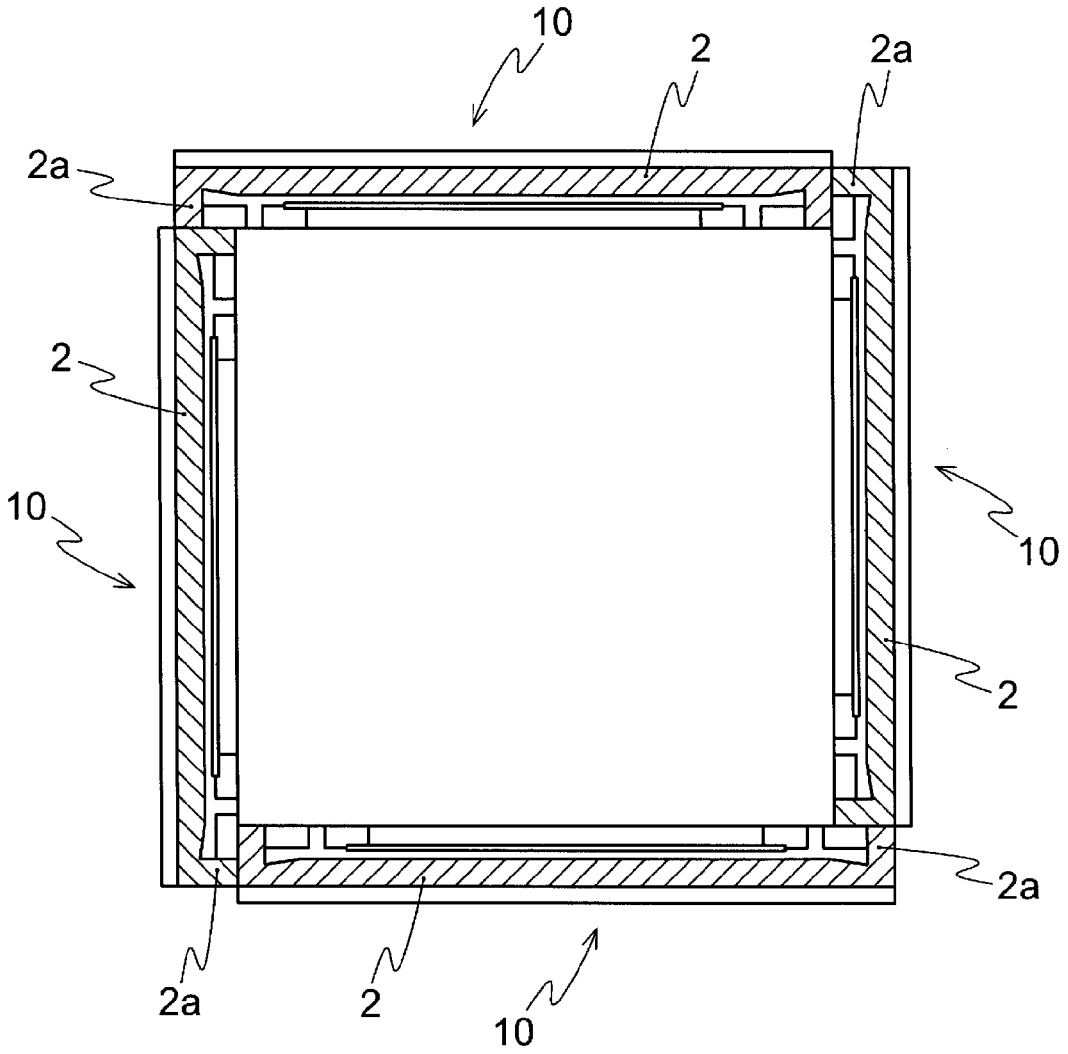
FIG. 4 is a plan view of another embodiment of the heating head of the presently disclosed embodiment having a two-dimensional structure.

FIG. 4 illustrates an example of forming a two-dimensional heating head by two-dimensional connection but not one-dimensional connection of the heating head units 10. Namely, the heating head units 10 of the presently disclosed embodiment are characterized in that the electrode connecting portions 2*a* of the heating element 2 bent at the both ends thereof are extended up to the side edge 1*a* located in the extending direction thereof and the electrode connecting portions 2*a* are arranged so as to be continuously connected to the end portions of the other heating elements. Since the electrode connecting portions 2*a* are also connected to the electrodes 3, there is somewhat a decrease of its temperature, but this is not a so large temperature change, and the electrodes can be connected to the heating element 2 bent at a right angle at the both ends thereof. As a result, as shown in FIG. 4, a heating head having a heating portion in a square shape can be obtained.

Even in the case of producing a two-dimensional heating head, a heating head in a rectangular shape but not a square shape can be produced and also, a heating head having a desired size can be produced by connecting two or more heating head units 10 on one side. In addition, when two or more heating head units 10 are connected in order to make a length of one side long, the connection shown in FIG. 3 may be employed and a length of a heating head can be selected freely. Thus, a heating head having a desired shape can be obtained.

In the case where producing a heating head by continuously connecting the electrode connecting portion 2*a* of one heating head unit 10 to the heating element 2 of the other heating head unit 10 as shown in FIG. 4, if the electrode 3 extends to the end portion of the head substrate 1 as shown in FIG. 1B, since the electrode 3 has a large heat conductivity, the temperature of the heating element 2 on the electrode is likely to decrease. In order to keep the temperature of the surface of the head substrate 1 to be pressed onto the medium for heating, it is preferable to make the overlapping portion of the electrode 3 and the electrode connecting portion 2*a* short enough to the extent that the electrical connection of the electrode 3 to the electrode connecting portion 2*a* can be assured, without forming the electrode 3 up to the end portion of the head substrate 1. However, in the case of using the back surface of the head substrate 1 different from one surface (the surface where the heating element 2, etc. are provided) or the side surface of the head substrate 1 for pressing to a medium to be heated, since the temperatures thereof are easily kept uniform, the use of these surfaces does not produce so much effect on uniform heating, even if the electrode 3 extends to the end portion of the head substrate 1. Further, as explained next by reference to FIG. 5, it is possible to form a bent portion 2*c* for connecting to the electrode by further bending the electrode connecting portion 2*a* in the direction of the long side to be formed into a reversed U-shape.

Figure 5A:
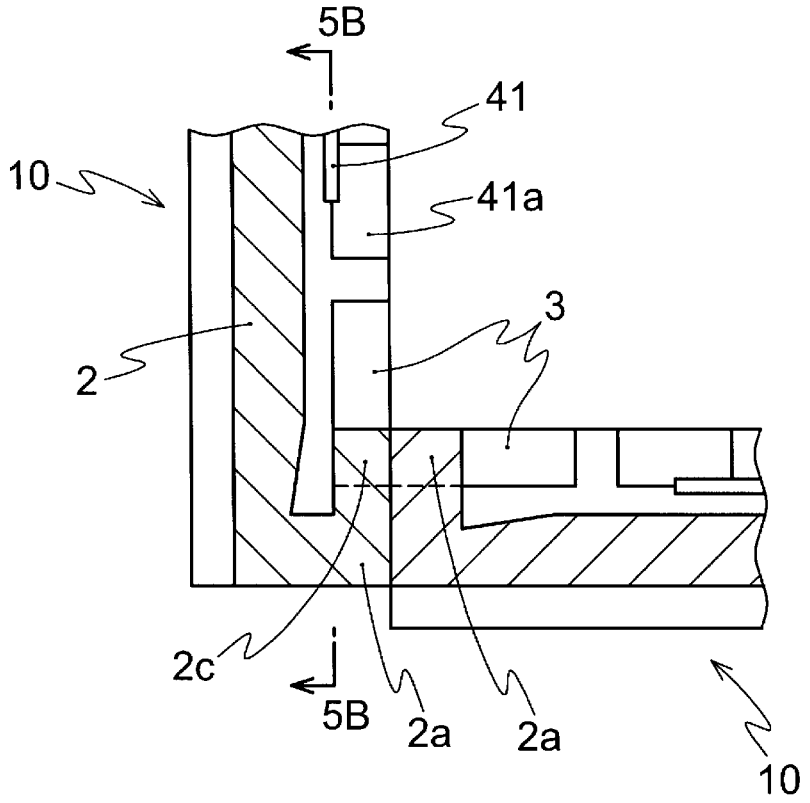
FIG. 5A is a partial plan view showing another example of a two-dimensional structure of the heating head of the presently disclosed embodiment.
Figure 5B:
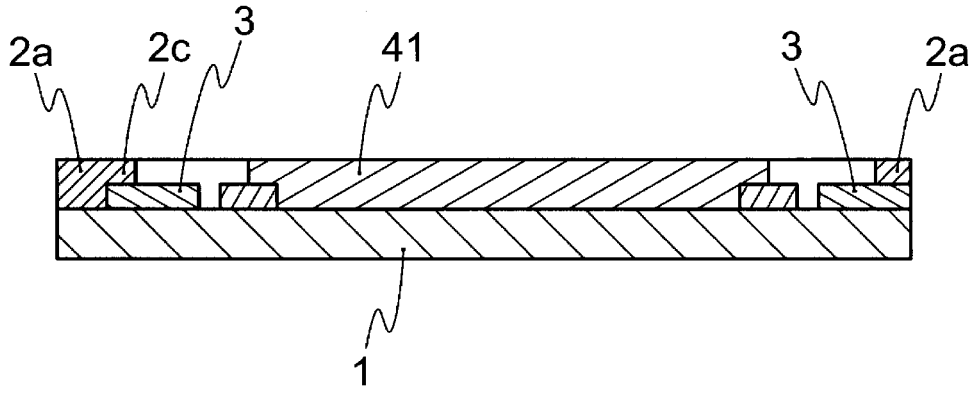
FIG. 5B is a sectional view of the heating head unit in 5B-5B line of FIG. 5A.

Namely, FIG. 5A is an enlarged view of a corner portion similar to one shown in FIG. 4, and FIG. 5B is a cross-sectional view of one heating head unit in 5B-5B line of FIG. 5A which is similar to FIG. 1B. As shown in FIG. 5A, at one end of the heating head units 10, the end of the electrode connecting portion 2*a* is further bent along the long side of the head substrate 1 to form the bent portion 2*c* for connecting to the electrode in a reversed U-shape, and the bent portion 2*c* is connected to the electrode 3. According to such a configuration, while the heating elements 2 are connected in a square shape, there exist no electrode under the heating portion, and the temperature of the heating portion is easily kept uniform. In the example shown in FIGS. 5A and 5B, while the bent portion 2*c* for connecting to the electrode is formed in a reversed U-shape only at one end of the heating head unit 10, it is possible to form the reversed U-shape at both ends to make the heating head unit 10 symmetric. In addition, in FIGS. 5A and 5B, the same symbols as those shown in FIG. 1 are affixed to the same portions and explanation thereon are deleted.

FIG. 6 is a plan view of other embodiment of the heating head for two-dimensional heating using the heating head unit 10 of the presently disclosed embodiment. That is to say, in the heating head unit 10 shown in FIG. 6, at the both ends of the heating elements 2, protruded portions 2*d* reaching the side edge 1*b* of the head substrate 1 at the opposite side of the electrode connecting portion 2*a* are formed. The protruded portions 2*d* are formed with an enough width being connectable to the end portion of the heating element 2 of the neighboring heating head unit 10. Therefore, in the case of forming a heating head having a square shape as shown in FIG. 6, when the protruded portion 2*d* is formed only on one portion of each heating head unit 10, the heating elements 2 can be continuously connected in a square shape. The protruded portion 2*d* may be formed at two or more portions or may be formed in an overall length of the head substrate 1 from one end to another end thereof so as to reach the side edge 1*b* of the head substrate 1.

It is preferable, from the viewpoint of easy production, to dispose the protruded portion 2*d* at a minimum position as mentioned above, since in the case where after forming a plurality of heating elements 2 at the same time by printing on a large head substrate for multiple head substrates, the large head substrate is divided into some pieces, it is not necessary to cut the portion of the heating element. Further, if a scribing line is provided beforehand, dividing the large head substrate can be carried out without causing a fracture of the heating element 2. Therefore, if the protruded portion 2*d* is formed over the entire length from one end to another end of the heating element 2, in other words, if the heating element 2 is formed to reach the side edge 1*b*, it is possible to obtain two-dimensional heating head shown in FIG. 6 as it is. In addition, in FIG. 6, too, the same symbols are affixed to the same portions as in FIG. 1A, and explanation thereon is deleted.

Figure 7:
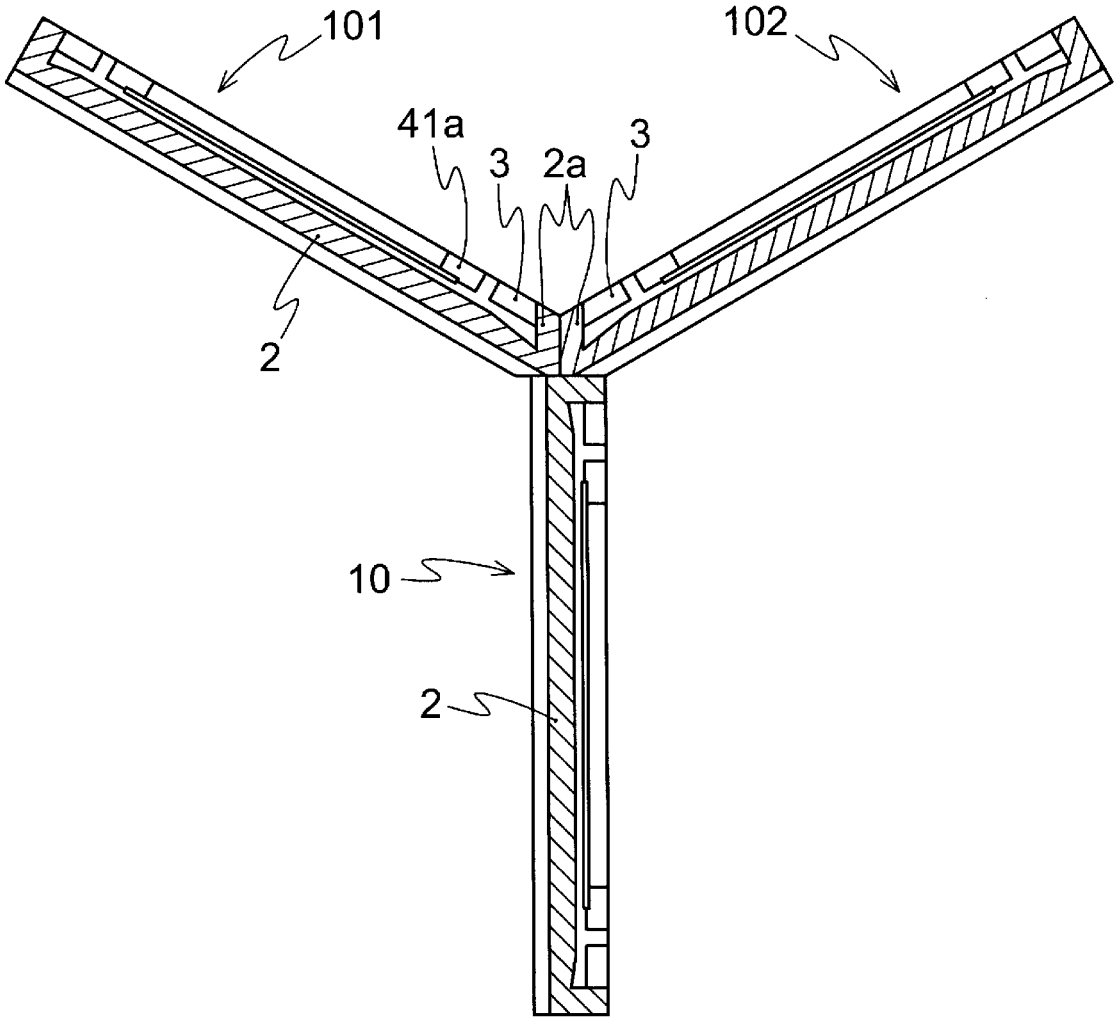
FIG. 7 is a plan view of other example of a two-dimensional structure of the heating head of the presently disclosed embodiment.

FIG. 7 is a plan view of other embodiment of the heating head for two-dimensional heating. Namely, in the example shown in FIG. 7, at one end of the heating head unit 10, the long side and the short side of the head substrate 1 are cut diagonally but not at a right angle, and in the example shown in FIG. 7, one end of the heating head unit 101 is cut so that the angle made by the long side and the short side thereof is about 60°, and also, one end of the heating head unit 102 is cut so that the angle made by the long side and the short side thereof is about 60°. The cut portions of the two heating head units 101 and 102 are connected to connect the heating elements 2 of the both. The apex of the connected portion of the two heating head units 101 and 102 is cut off, and to this cut portion is butt-jointed a third heating head unit 10 having a usual shape so that the heating elements 2 are continuously connected. As a result, the respective heating head units are connected at an angle of 120° to form a heating head unit having a Y-shape. Each one end of the two heating head units 101, 102 are cut to be formed into a shape shown in FIG. 7. However, the structure of these units are the same as that of the heating head unit shown in FIG. 1A except that there is a difference in the shape of the electrode connecting portion 2*a* of the heating element. The same symbols are affixed to the same portions as in FIG. 1, and explanation thereon is deleted.

With the structure as mentioned above, a heating head unit having a Y-shape can be formed. The cutting angle at one end of the heating head unit 101, 102 is not limited to 60°, and the angle is adjusted to a desired one, and for example, X-shaped, Z-shaped, or diagonal heating head can be formed, and also, the heating head is not limited to two-dimensional one, and a three-dimensional heating head can be formed. Further, in the heating heads shown in FIGS. 4 to 6, by removing the neighboring two sides among the four sides, L-shaped or T-shaped heating head can be formed.

As mentioned above, according to the heating head unit of the presently disclosed embodiment, the length of one heating element 2 is as short as about 50 mm and its temperature non-uniformity is small. Therefore, in the case of heating of a short card, very stable heating can be carried out by using one heating head unit as a heating head. Further, even in the case of connecting several heating head units to form one-dimensional heating head or two-dimensional or three-dimensional heating head for wide media, temperatures of the respective heating head units 10 can be adjusted, and therefore, a heating head having a very uniform temperature distribution as a whole can be obtained. If such a two-dimensional heating head is used, for example, even in the case of carrying out sealing of a vinyl package, by placing, for example, drugs to be packaged on a vinyl sheet, folding the vinyl sheet and then heating the vinyl sheet using the heating head as shown in FIGS. 4 to 6, the circumference of the vinyl sheet can be sealed at once. In the case of folding one side of the vinyl sheet, as mentioned above, the heating head may be formed into a shape having three sides but not a quadrangular shape.

In the case of such a heating head using one heating head unit 10, recording in a card or the like or erasing a record are carried out by the method shown in the schematic view of FIG. 8 showing the case of re-transferring. Namely, in the example shown in FIG. 8, the back surface of the head substrate 1 is a pressing surface, and a silicone sheet 12 coated with a fluorine-containing resin layer such as a polytetrafluoroethylene thin film is adhered to the back surface. It is preferable to provide, as a smooth material layer, a layer (not shown in the drawing) comprising aluminum nitride, boron fluoride or the like on the fluorine-containing resin layer, in order to transfer a medium 31 smoothly. The purpose of this is to make the transfer of the medium 31 smooth even if there is non-uniformity on the surface of the medium 31 due to embedding of IC in the medium. Further, if non-uniformity of the medium surface is so large, it is possible to use a silicone sponge or the like instead of the silicone sheet 12. By using this heating head, pressing the pressing surface of the heating head onto a rubber roller 32 with the both being disposed oppositely and passing the medium 31 and a transfer film 33 between the both, for example, information such as characters recorded on the transfer film 33 by transferring can be retransferred to the medium 31 using heat of the heating head. FIG. 8 illustrates a roller 32 configured such that a surface layer 32*a* comprising a heat resistant rubber such as a silicone rubber or a fluorine-containing rubber is provided on the outer surface of the roller, and an inner layer 32*b* comprising an insulating rubber such as a foamable silicone rubber or a fluorine-containing rubber is provided at the inner side of the surface layer and is fixed to a rotation shaft 32*c*. However, the structure of the roller is not limited thereto.

Figure 9:
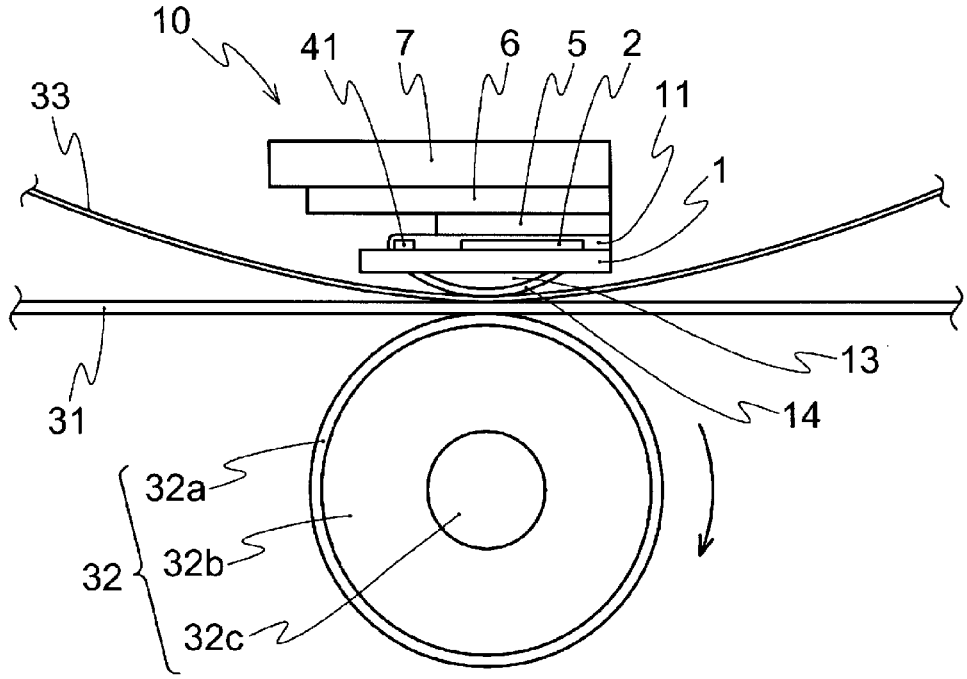
FIG. 9 is a schematic view of another example of a device for heating a medium using the heating head of the presently disclosed embodiment.

In the example shown in FIG. 8, the silicone sheet 12 coated with a fluorine-containing resin layer on the overall back surface of the head substrate 1 of the heating head unit 10 is provided. However, by forming this layer only on the portion to be pressed, even if the pressing force is week, a strong pressure can be applied to the portion to be pressed. An example thereof is shown in FIG. 9. Namely, in FIG. 9, a silicone sponge layer 13 and a fluorine-containing resin layer 14 are configured so as to be formed partially on the back surface of the head substrate 1 but not on the entire back surface of the head substrate 1, and only this portion presses the medium 31. Other configuration is the same as in the example shown in FIG. 8, and the same symbols are affixed to the same portions and explanation thereof is deleted. In addition, in this example, too, it is preferable to provide a smooth material layer on the surface of the fluorine-containing resin layer 14. The smooth material layer is not shown in the drawing.

Figure 10:
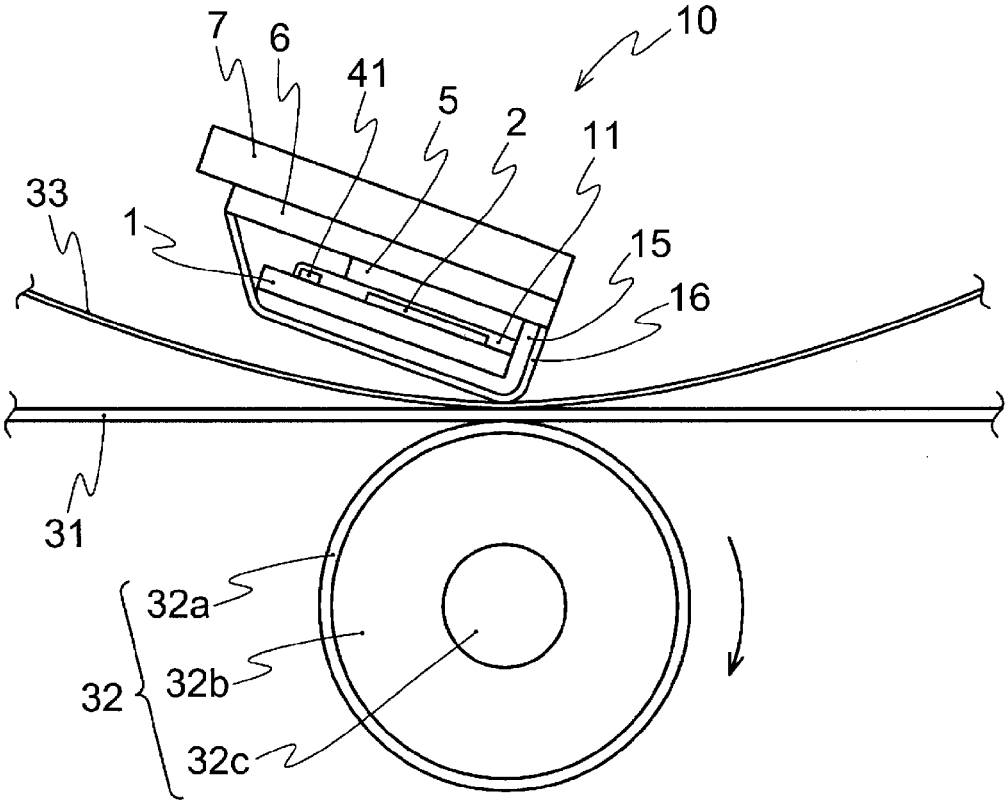
FIG. 10 is a schematic view of other example of a device for heating a medium using the heating head of the presently disclosed embodiment.

FIG. 10 illustrates other embodiment. In the example shown in FIG. 10, a silicone resin layer 15 is formed by coating a liquid silicone resin on outer peripheries of the head substrate 1 and the second substrate 5 and then curing it, and on the surface of the silicone resin layer 15, a fluorine-containing resin layer (coating film) 16 is provided fixed to a circuit board 6 and the like. The fluorine-containing resin layer 16 is hardly adhered with an adhesive, and therefore, is extended up to the circuit board 6 and fixed to the circuit board, for example, with a screw or the like not shown in the drawing. Further, the corner portion of the heating head unit 10 is pressed onto the medium 31, thereby enabling a pressure to be applied effectively even with a small pressing force. Other configuration is the same as in the example shown in FIG. 8, and the same symbols are affixed to the same portions and explanation thereof is deleted. The explanation made above on the smooth material layer is also applied to this example.

According to the aspects of the disclosed embodiment, in the case of a long one-dimensional heating head produced by connecting a plurality of heating head units 10, media having any given width can be heated, and the heating head can be used for color development of a heat-sensitive paper having any given size; recording and erasing by heating of a heat-sensitive re-writable media; transferring by heating, retransferring and toner fixing of a transfer film; adhesion, fusion and deformation by heating; over-coating for protecting surfaces of a paper and an image from a solvent, gas, light and the like and for making an image surface have a mirror surface to obtain a clear image; lamination of documents; partial adhesion of a heat curing adhesive sheet; imprinting for forming a convexoconcave surface on a plastic and the like by thermal processing; and the like. In addition, conventionally when recording and erasing of a thermal reversible heat-sensitive paper were repeated 500 to 1000 times, erasing of a record became insufficient and a clear recording could not be obtained. However, in the presently disclosed embodiment, since the temperature of the heating head is uniform, sufficient erasing can be done as compared with conventional devices, and clear recording can be carried out up to about 1000 times. Further, the heating head of the presently disclosed embodiment can be used for heating for various purposes such as retransferring, overall transfer coating, image recording, processing for prevention of discoloration, processing for prevention of corrosion, adhesion of electrically conductive material, coloration and the like or chemical reaction, drying, plastic molding, fixing of a toner by heating and the like.

What is claimed is:

1. A heating head unit comprising:

a rectangular head substrate having long sides and short sides, a strip-like heating element provided continuously on one surface of the head substrate from one end to another end of the head substrate along the long side of the head substrate, a pair of electrode connecting portions formed from the same material as that of the heating element where the heating element is bent and extends along the short side of the head substrate at both ends of the heating element to form the pair of electrode connecting portions, a pair of electrodes formed on the one surface of the head substrate between the strip-like heating element and the side edge of the long side of the head substrate at the side where the electrode connecting portions are provided, wherein the electrodes are electrically connected with each other while being partially brought into contact with each of the pair of electrode connecting portions, and a substrate temperature control means for controlling the substrate temperature by measuring the temperatures of the head substrate and a temperature measurement element.

2. The heating head unit of claim 1, wherein at both ends of the heating element, an angle formed by the heating element and the electrode connecting portions is an acute angle by forming the heating element with a narrower width at the corner sections than a width at a center portion, the angle being formed between the electrode connecting portion extending along the short side of the head substrate and the strip-like heating element extending along the long side of the head substrate.

3. The heating head unit of claim 2, wherein one end of at least one of the pair of electrode connecting portions is further bent along the long side to form a bent portion for connecting to the electrode, and at least one of the pair of electrodes is electrically connected to the bent portion for connecting to the electrode.

4. The heating head unit of claim 1, wherein at least a part of an edge of the heating element along the long side at the opposite side to the side having the electrode connecting portion is formed so as to reach an edge of the head substrate along the long side thereof.

5. A heating head comprising, two or more of the heating head units of claim 1, wherein the heating head units are arranged in a line continuously so that the heating elements are disposed adjacently continuously to each other along the long side of the head substrate.

6. A heating head being capable of heating two-dimensionally or three-dimensionally a medium comprising, two or more heating head units of claim 1, wherein the heating head units are arranged continuously in a direction intersecting the long side of the head substrate, and disposing the heating element of one heating head unit is disposed adjacently continuously to the heating element or the electrode connecting portion of other heating head unit.

* * * * *